US006813452B2

(12) United States Patent
Jung et al.

(10) Patent No.: US 6,813,452 B2
(45) Date of Patent: Nov. 2, 2004

(54) METHOD OF DETERMINING TIME TO REPLACE DEVELOPING SOLUTION OF PRINTER

(75) Inventors: Sun-hae Jung, Gyeonggi-do (KR); Seung-wan Lee, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 109 days.

(21) Appl. No.: 10/189,497

(22) Filed: Jul. 8, 2002

(65) Prior Publication Data

US 2003/0103775 A1 Jun. 5, 2003

(30) Foreign Application Priority Data

Dec. 1, 2001 (KR) ..... 2001-75676

(51) Int. Cl.[7] ..... G03G 15/00; G03G 15/10

(52) U.S. Cl. ..... 399/49; 399/57

(58) Field of Search ..... 399/27–29, 49, 399/57–60, 233, 237; 348/179; 358/1.9, 406, 504, 518, 520; 382/162, 167

(56) References Cited

U.S. PATENT DOCUMENTS 4,800,839 A * 1/1989 Ariyama et al. ..... 399/57

6,008,907 A * 12/1999 Vigneau et al. ..... 358/1.9

6,289,184 B1 * 9/2001 Yoo et al. ..... 399/57

* cited by examiner

*Primary Examiner*—William J. Royer

(74) *Attorney, Agent, or Firm*—Staas & Halsey LLP

(57) ABSTRACT

A method of determining a time to replace developing solutions in a printer includes providing a reference card including sample patches of standard colors for predetermined colors of the developing solutions, sample patches of test colors into which the standard colors change due to contamination, and standard color differences ΔE* calculated from standard color values $E_s$* corresponding to the respective standard colors and measured standard contamination values $E_c$* corresponding to the respective test colors; inputting information about test patches for the predetermined colors into the printer and printing the test patches; and comparing the sample patches with the test patches to determine whether to replace the developing solutions. Since the reference card is provided together with a printer including information about test patches, a user can easily determine a time to replace a developing solution.

39 Claims, 5 Drawing Sheets

METHOD OF DETERMINING TIME TO REPLACE DEVELOPING SOLUTION OF PRINTER

CROSS-REFERENCE TO RELATED APPLICATION

This application claims the benefit of Korean Application No. 2001-75676, filed Dec. 1, 2001, in the Korean Intellectual Property Office, the disclosure of which is incorporated herein by reference.

BACKGROUND OF THE INVENTION

1. Field of the Invention

The present invention relates to a method of determining a time to replace a developing solution using a color difference depending on the degree of contamination of the developing solution in a printer.

2. Description of the Related Art

A developing solution of a printer is a mixed solution of a toner and a carrier to dissolve the toner and provides a developing agent used to develop a latent electrostatic image.

FIG. 1 is a sectional view of a conventional wet color printer. Referring to FIG. 1, the wet color printer includes a photoreceptor belt 14, a charger 15 to charge the photoreceptor belt 14, laser scanning units 16 to scan light onto the charged photoreceptor belt 14 to form a latent electrostatic image, developers 30 to develop the latent electrostatic image, a drier 18 to absorb a liquid carrier on the photoreceptor belt 14 and to evaporate the liquid carrier, and a transfer unit 20 to transfer an image to a sheet 23.

The photoreceptor belt 14 is entrained about a plurality of rollers including a drive roller 11 and driven rollers 12 and 13. The sheet 23 is led into the transfer unit 20 by the rotation a transfer roller 21 and a fusing roller 22, and an image is transferred to the sheet 23. The laser scanning units 16 scan color information of yellow (Y), cyan (C), magenta (M), and black (K) onto the photoreceptor belt 14. The corresponding developers 30 supply developing solutions of corresponding colors to the photoreceptor belt 14. Each of the developers 30 includes a developing solution supplier 32 to supply a developing solution to the photoreceptor belt 14, and a developer tank 31 to collect the developing solution that drops from the photoreceptor belt 14. The developer tank 31 includes a developer roller 36, a brush roller 37 to remove the developing solution from the developer roller 36, a squeeze roller 34 to extract a liquid carrier which does not form an image from the developing solution supplied onto the photoreceptor belt 14, and a plate 35 to guide the carrier extracted through the squeeze roller 34 to the developer tank 31.

The developing solution supplier 32 is provided with a developing solution of an appropriate concentration. The developing solution is made by mixing a solvent (i.e., a liquid carrier (NORPAR)) and a developer (i.e., a toner) from a developing solution providing unit 38 and a developing solution from the developer tank 31, and supplies the developing solution to the photoreceptor belt 14.

In such a conventional wet electrophotographic color printer, a carrier dissolves a toner attached to the photoreceptor belt 14 to develop a latent electrostatic image during development. The carrier may not be collected into a developer tank 31 provided for a color corresponding to the carrier, but may be transported attached to the photoreceptor belt 14 to a developer tank 31 provided for other colors. In addition, when some of a toner is not transferred to the sheet 23 and remains on the photoreceptor belt 14 even after transferring performed by transfer unit 20, the toner may be collected into a developer tank 31 which does not correspond to the color of the toner while the photoreceptor belt 14 circulates. In this case, different colors are mixed within the developing solution suppliers 32, so an image of desired colors cannot be obtained and a picture quality deteriorates. Particularly, when a black toner is mixed with a yellow toner, it is very difficult to present a normal yellow color, which fatally affects the quality of printing.

SUMMARY OF THE INVENTION

To solve the above and other problems, it is an object of the present invention to provide a method of determining a time to replace a developing solution by simply measuring the degree of contamination of the developing solution.

Additional objects and advantages of the invention will be set forth in part in the description which follows and, in part, will be obvious from the description, or may be learned by practice of the invention.

To achieve the above and other objects of the present invention, there is provided a method of determining a time to replace a developing solution in a wet electrophotographic printer including developing solutions of predetermined colors according to an embodiment of the invention, the method comprising providing a reference card in which sample patches of standard colors for the predetermined colors of the developing solutions, sample patches of test colors into which the standard colors change due to contamination, and standard color differences $\Delta E^*$ calculated from standard color values $E_s^*$ corresponding to the respective standard colors and measured standard contamination values $E_c^*$ corresponding to the respective test colors are arranged; inputting information about test patches for the predetermined colors into the printer and printing the test patches; and comparing the sample patches with the test patches to determine whether to replace the developing solutions.

According to an aspect of the invention, the providing the reference card includes setting the standard colors for the predetermined colors and the test colors into which the standard colors change depending on contamination; calculating the standard color values $E_s^*$ corresponding to the respective standard colors and the measured standard contamination values $E_c^*$ corresponding to the respective test colors; calculating the standard color differences $\Delta E^*$ from the standard color values $E_s^*$ and the measured standard contamination values $E_c^*$; and providing the reference card in which the sample patches corresponding to the standard colors and the sample patches corresponding to the test colors are arranged in order of the standard color differences $\Delta E^*$.

According to another aspect of the invention, in the setting the standard colors, each of the standard color values $E_s^*$ is defined by three variable values including a standard value of lightness $L_s^*$, a standard value of red-greenness $a_s^*$, and a standard value of yellow-blueness $b_s^*$, and each of the measured standard contamination values $E_c^*$ is defined by three variable values including a measured standard contamination value of lightness $L_c^*$, a measured standard contamination value of red-greenness $a_c^*$, and a measured standard contamination value of yellow-blueness $b_c^*$.

According to yet another aspect of the invention, in the calculating the standard differences $\Delta E^*$, the standard color differences $\Delta E^*$ satisfy Equation (1).

$$\Delta E^*=\{(\Delta L^*)^2+(\Delta a^*)^2+(\Delta b^*)^2\}^{1/2}$$

$$\Delta L^*=L_s^*-L_c^*$$

$$\Delta a^*=a_s^*-a_c^*$$

$$\Delta b^*=b_s^*-b_c^* \quad (1)$$

According to still another aspect of the invention, the inputting the information about the test patches includes inputting the information about the test patches into the printer; commanding the printer to print the test patches; and printing the test patches in response to the command.

According to a further aspect of the invention, in the printing the test patches, measured contamination values $E_c$ of the respective test patches are printed together with the test patches.

According to a still further aspect of the invention, each of the measured contamination values $E_c$ is defined by three variable values including a measured contamination value of lightness $L_c$, a measured contamination value of red-greenness $a_c$, and a measured contamination value of yellow-blueness $b_c$.

According to a yet further aspect of the invention, in the printing the test patches, measured color differences ΔE corresponding to the measured contamination values $E_c$ of the respective test patches are also printed together with the test patches.

According to a still yet further aspect of the invention, the measured color differences ΔE satisfy Equation (2).

$$\Delta E=\{(\Delta L)^2+(\Delta a)^2+(\Delta b)^2\}^{1/2}$$

$$\Delta L=L_s^*-L_c$$

$$\Delta a=a_s^*-a_c$$

$$\Delta b=b_s^*-b_c \quad (2)$$

According to an additional aspect of the invention, the comparing the sample patches with the test patches includes comparing the sample patches with the test patches; and replacing a developing solution when it is determined that a test patch corresponding to the color of the developing solution is more contaminated than a sample patch corresponding to a particular measured standard contamination value $E_c^*$ for the color of the developing solution.

According to another embodiment of the present invention, a reference card includes standard colors for predetermined colors, test colors into which the standard colors change due to contamination, and color differences calculated from standard color values corresponding to the respective standard colors and measured standard contamination values corresponding to the respective test colors, the reference card to be provided with a printer including information about test patches for the predetermined colors so that users can easily discriminate the degrees of contamination of developing solutions with the naked eye and simply determine a time to replace each of the developing solutions.

BRIEF DESCRIPTION OF THE DRAWINGS

The patent or application file contains at least one drawing executed in color. Copies of this patent or patent application publication with color drawing(s) will be provided by the U.S. Patent and Trademark Office upon request and payment of the necessary fee. The above and other objects and advantages of the present invention will become more apparent and more readily appreciated by describing in detail embodiments thereof with reference to the attached drawings in which.

DETAILED DESCRIPTION OF THE EMBODIMENTS

Figure 1:
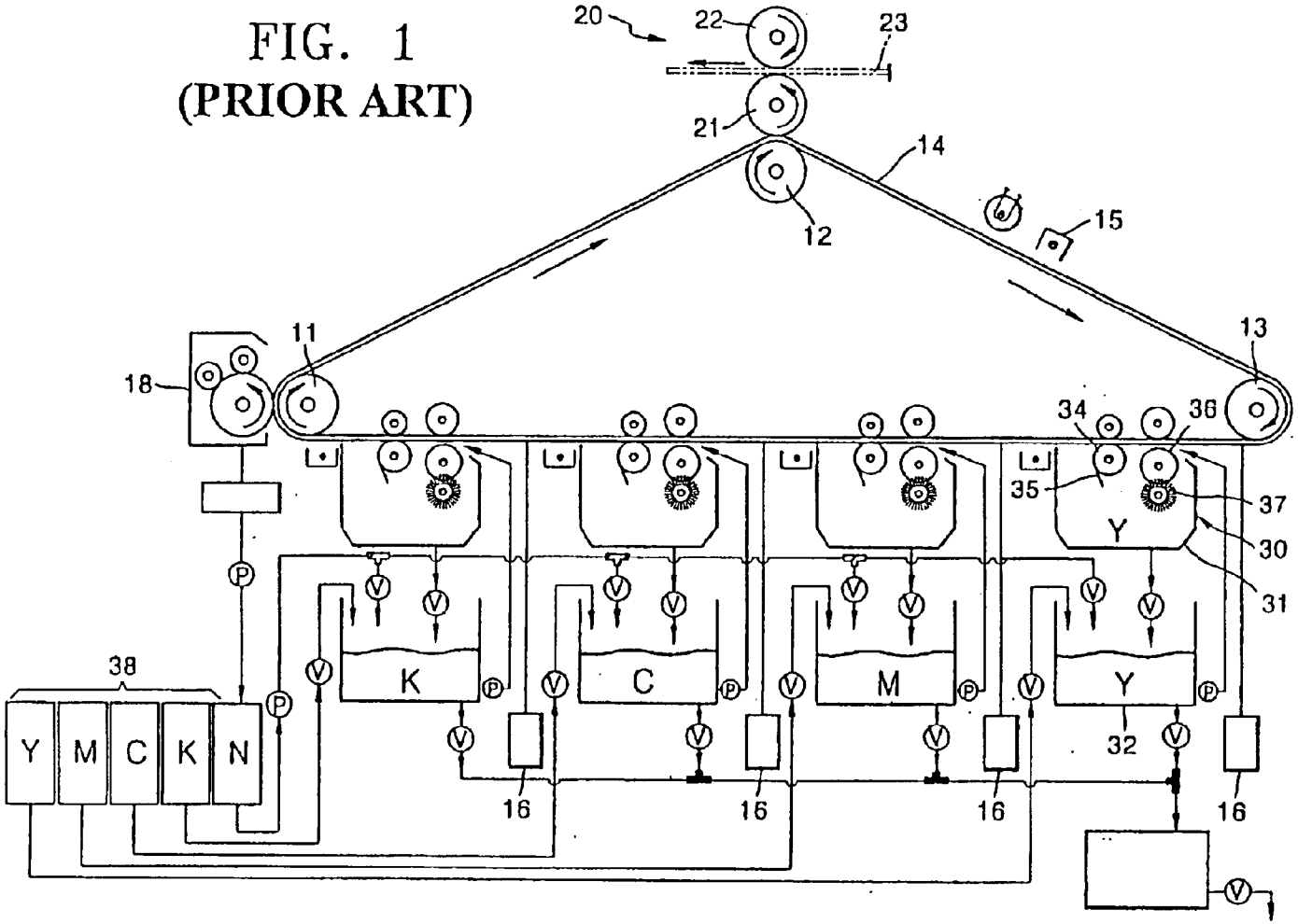
FIG. 1 (PRIOR ART)
FIG. 1 is a sectional view of a conventional wet color printer.

Hereinafter, embodiments of a method of determining a time to replace a developing solution of a wet printer according to the present invention will be described in detail with reference to the accompanying drawings. The same reference numerals in different drawings represent the same element.

To overcome these problems, this applicant discloses in Korean Patent Publication No. 2000-27135 an apparatus and method to measure the degree of contamination of a developing solution by radiating light at an inlet and an outlet through which the developing solution flows in and out, and to compare the quantities of light received therefrom. The disclosure of Korean Patent Publication No. 2000-27135 is incorporated by reference.

Figure 2:
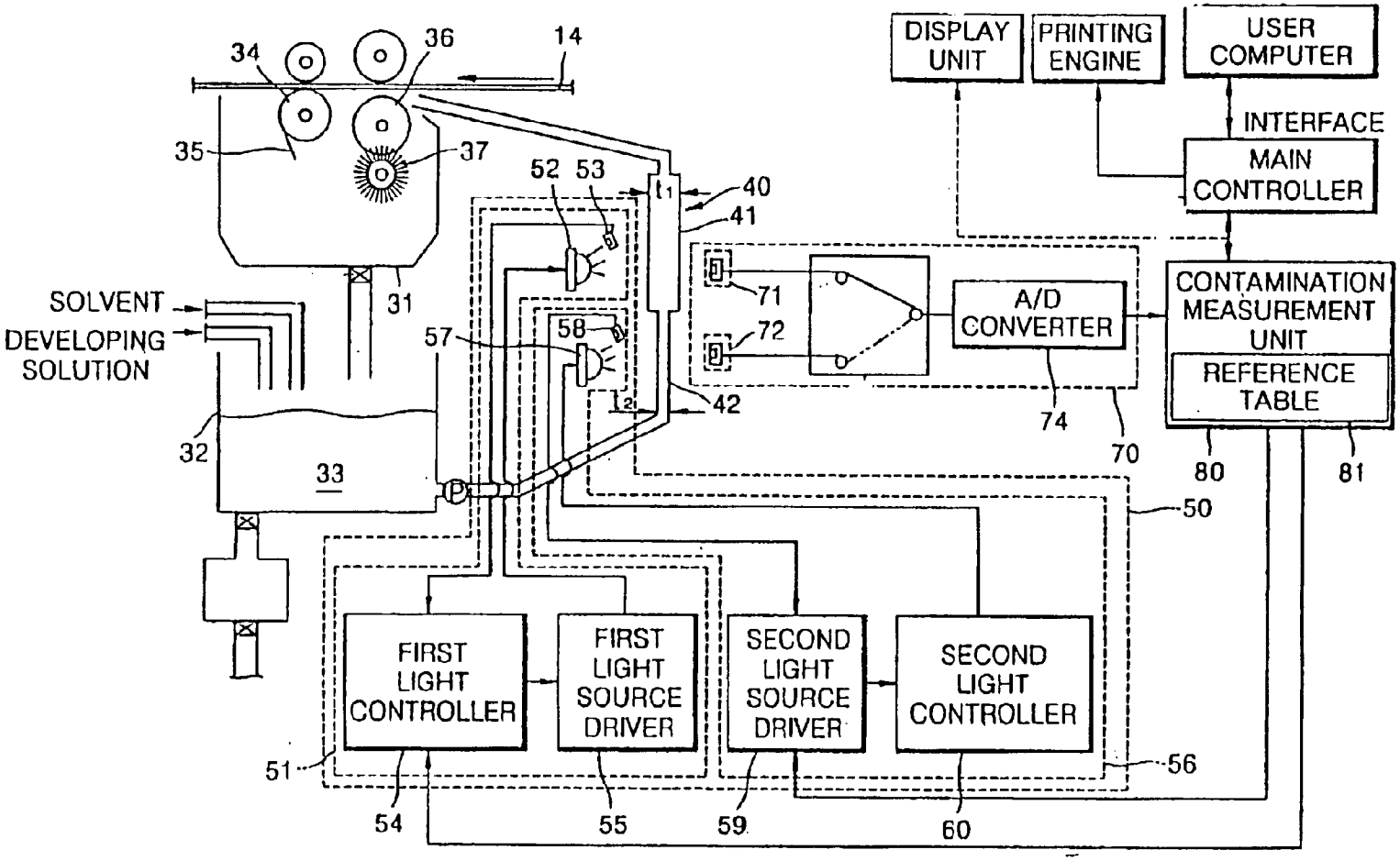
FIG. 2 is a wet color printer having an apparatus to measure the degree of contamination of a developing solution.

FIG. 2 is a diagram of a wet color printer having an apparatus to measure the degree of contamination of a developing solution which is disclosed in Korean Patent Publication No. 2000-27135. Referring to FIG. 2, the apparatus includes a developing solution pipe 40, a light emission unit 50, a photodetection unit 70, and a contamination measurement unit 80. The apparatus further includes a first pipe portion 41 which has a first clearance t1, and a second pipe portion 42 which has a second clearance t2. The apparatus further includes a first emitter 51 and a second emitter 56, a first light source 52 and a second light source 57, a first photodetector 71 and a second photodetector 72, a third photodetector 53 and a fourth photodetector 58, a first light controller 54 and a second controller 60, a first light source driver 55 and a second light source driver 59, and an analog-to-digital (A/D) converter 74.

The above apparatus compares the quantities of light of first and second receiving light signals obtained from the first and second pipe portions 41 and 42, respectively, having different gaps. The first and second pipe portions 41, 42 are filled with a developing solution 33, an the degree of contamination is calculated. Concentration values of pure toners and values of the degree of contamination are measured through tests in advance and are recorded in a reference table 81. In measuring the degree of contamination of the developing solution 33, a difference between the first and second receiving light signals is calculated, and a value of the degree of contamination corresponding to the difference is obtained referring to the reference table 81.

While the above apparatus provides good results, since the above apparatus uses a light emitter and a light receiver, it is too expensive to be applied to all commercial printers.

Figure 3:
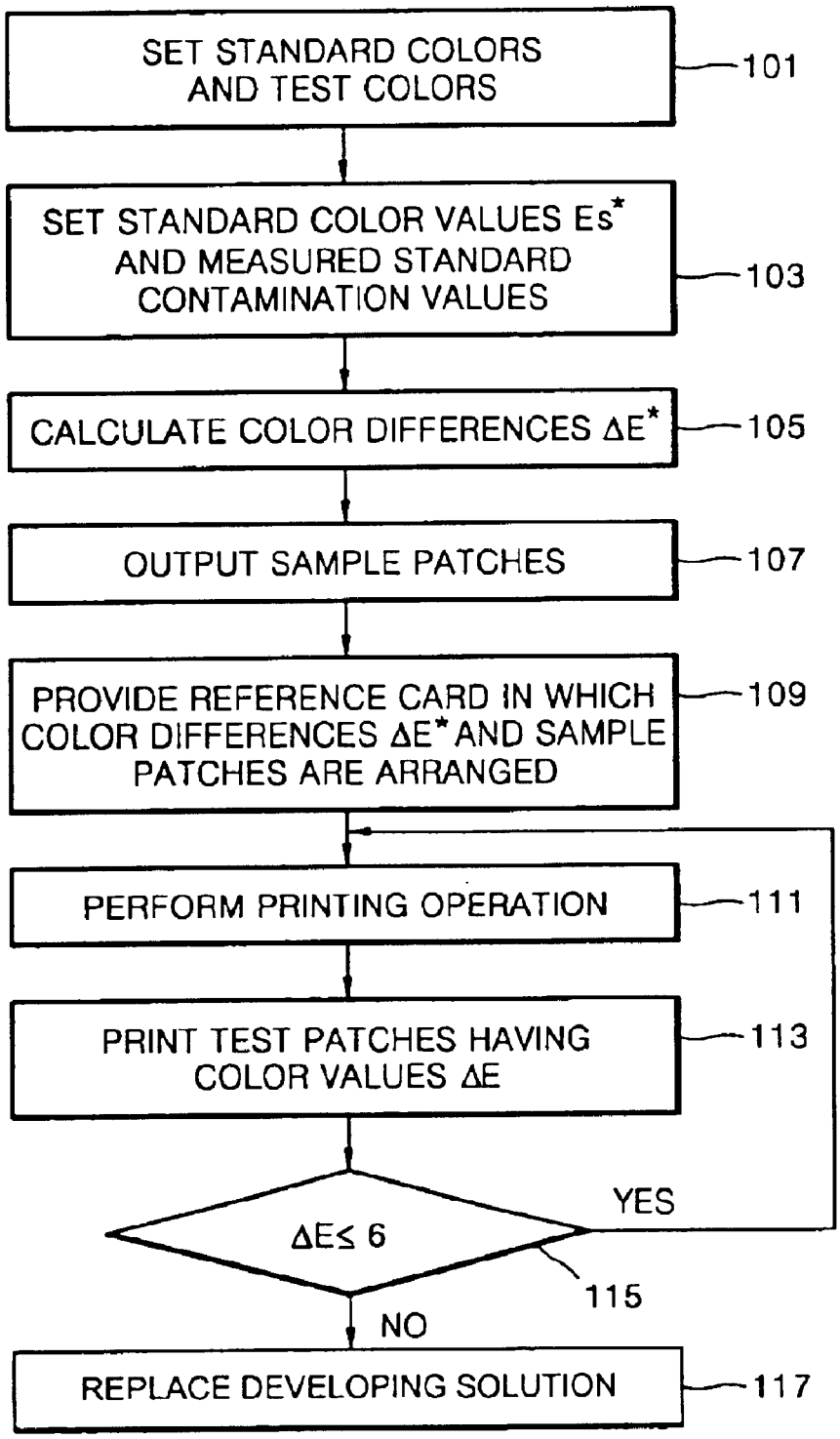
FIG. 3 is a flowchart of a method of determining a time to replace a developing solution according to an embodiment of the present invention.

FIG. 3 is a flowchart of a method of determining a time to replace a developing solution according to an embodiment of the present invention. Referring to FIG. 3, standard colors of yellow, cyan, magenta, and black and test colors, into which the standard colors change due to the contamination of the developing solutions, are set (operation 101). Standard color values $E_s^*$ corresponding to the standard colors and measured standard contamination values $E_c^*$ corresponding to the test colors are set as discrete values (operation 103).

In the embodiment of the present invention, among calorimeters suggested by Commission International de I'Eclairage (CIE) to define colors, an L*a*b* color space referred to as CIELab is used. L* indicates lightness, a* indicates redness-greenness, and b* indicates yellowness-blueness. In the embodiment of the present invention, the standard color values $E_s^*$ have coordinate values of ($L_s^*$, $a_s^*$, $b_s^*$) in the color space, and the measured standard contamination values $E_c^*$ have coordinate values of ($L_c^*$, $a_c^*$, $b_c^*$) in the color space.

Standard color differences ΔE* between the standard color values $E_s^*$ having coordinate values of ($L_s^*$, $a_s^*$, $b_s^*$) and the measured standard contamination values $E_c^*$ having coordinate values of ($L_c^*$, $a_c^*$, $b_c^*$) are calculated (operation 105). The standard color differences ΔE* are given by Equation (1).

$$\Delta E^* = \{(\Delta L^*)^2 + (\Delta a^*)^2 + (\Delta b^*)^2\}^{1/2}$$

$$\Delta L^* = L_s^* - L_c^*$$

$$\Delta a^* = a_s^* - a_c^*$$

$$\Delta b^* = b_s^* - b_c^* \quad (1)$$

Sample patches of the test colors corresponding to the respective standard color differences ΔE* are output (operation 107). A reference card in which the standard color differences ΔE* and the corresponding sample patches are arranged is provided (operation 109).

While not required in all aspects of the invention, the reference card is standardized through a number of tests so that the sample patches represent polluted colors into which individual standard colors of optimal developing solutions change depending on the degree of contamination occurring when a printer is used. The reference card will be described in detail with reference to FIG. 4 below.

When a user drives a printer provided with the reference card, a printing operation is performed (operation 111). As the printing operation is continued, developing solutions of the printer are gradually polluted, deteriorating the quality of printed images. When the user determines that the quality of a printed image deteriorates, the user can command the printer to print test patches previously stored in a main board of the printer in a predetermined form. Alternately, the user can input information or download information about the test patches through a printer controller such as a computer, and command the printer controller to output the information to the printer. Then, the printer prints out the test patches of the colors of the respective developing solutions (operation 113).

After comparing the colors of the test patches with the colors of the sample patches, if it is determined that a measured color difference ΔE of a test patch for a certain color is greater than a particular standard color difference ΔE* (e.g., 6), (operation 115, the user should replace a developing solution corresponding to the certain color (operation 117). If it is determined that a measured color difference ΔE of a test patch is less than the standard color difference ΔE* (e.g., 6), the user may continue the printing operation without replacing a developing solution. Here, the example value 6 of a standard color difference ΔE* is suggested as a reference for determining a time to replace a developing solution and is just an example. The reference value can be arbitrarily chosen by the user.

Figure 4:
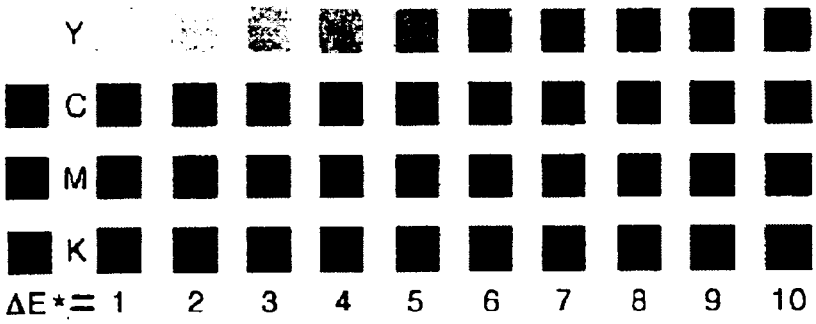
FIG. 4 shows a reference card used in a method of determining a time to replace a developing solution according to the embodiment of the present invention.

Referring to FIG. 4, a reference card provided according to the embodiment of the present invention is provided. The reference card includes the standard colors corresponding to the standard color values and the sample patches of the test colors corresponding to the measured standard contamination values whose standard color differences ΔE* with respect to the corresponding standard colors are set as discrete values 1 through 10.

The test colors of the sample patches corresponding to different standard color differences ΔE* change in predetermined directions due to a mixture of developing solutions occurring when a toner is not completely removed from a photoreceptor belt during a development process in a printer, as described above. Although the colors and color values corresponding to the measure standard contamination values $E_c^*$ and their standard color differences ΔE* may vary with the chromatic characteristics of the toners provided to a printer, the spatial adjacencies between colors on a photoreceptor belt, and the characteristics of a mechanical structure of the printer, the reference card provides values and colors objectified to some extent for a particular printer.

A reference card having more subdivided standard color differences than the reference card of FIG. 4 can be provided at the request of a user according to an embodiment of the invention. Moreover, it is understood that the standard color values $E_s^*$ and the measure standard contamination values $E_c^*$ can be represented using a measure such as CIEXYZ or CIEL*a*b* of other calorimeters instead of using the color space used in this embodiment of the present invention. Further, where additional colors are used in the printer, the reference card can be adjusted to provide standard color differences for the additional colors.

Figure 5:
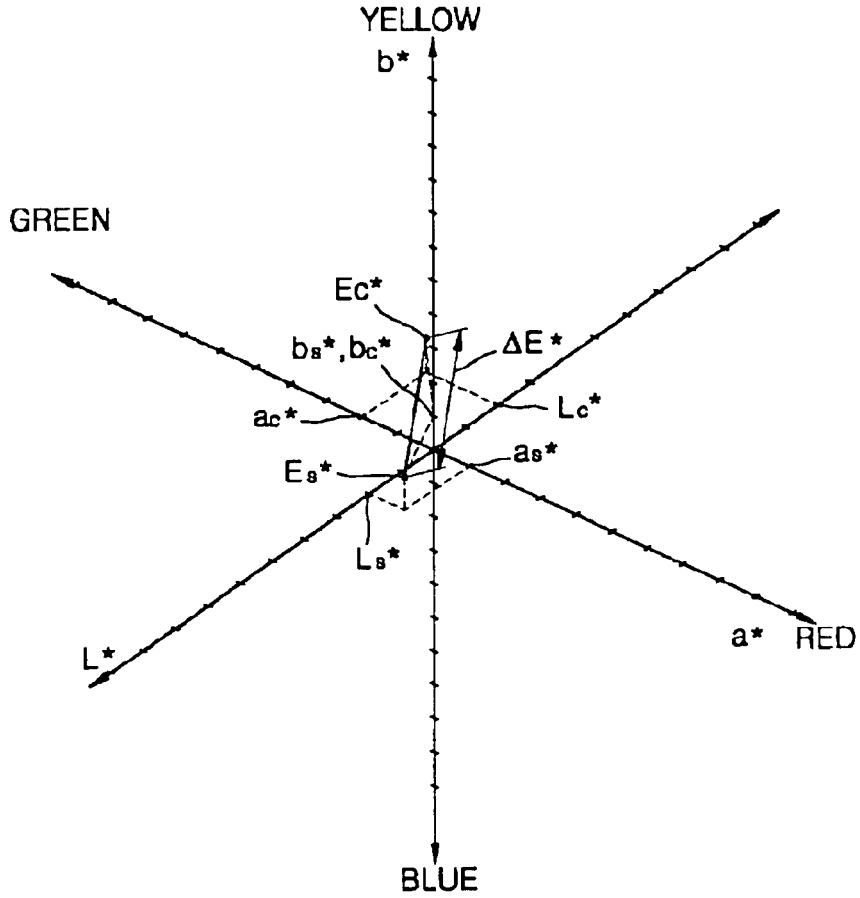
FIG. 5 shows color differences between standard colors and test colors in a method of determining a time to replace a developing solution according to the embodiment of the present invention.

FIG. 5 is a three-dimensional graph in which the standard color values $E_s^*$, the measured standard contamination values $E_c^*$, and the standard color differences ΔE* calculated according to Formula (1) are plotted in a color space according to an embodiment of the present invention. Referring to FIG. 5, $E_s^*$ is ($L_s^*$, $a_s^*$, $b_s^*$)=(2, 1, 1), $E_c^*$ is ($L_c^*$, $a_c^*$, $b_c^*$)=(−2, −2, 1), and ΔE* calculated by applying these values to Formula (1) is 5. As shown in FIG. 5, the standard color difference ΔE* indicates the distance between the standard color values $E_s^*$ and the measured standard contamination values $E_c^*$ in the color space. As the standard color difference ΔE* increases, the distance between the standard color values $E_s^*$ and the measured standard contamination values $E_c^*$ also increases, which indicates an increase in contamination of the corresponding developing solution.

Figure 6:
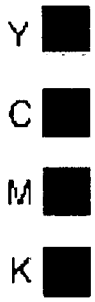
FIG. 6 shows test patches used in a method of determining a time to replace a developing solution according to the embodiment of the present invention.

FIG. 6 shows test patches, the information for which are stored in a printer or are input into a program of a computer according to embodiments of the present invention. Specifically, according to an embodiment of the invention, the printer is set to have information about test patches for the colors of the developing solutions in a predetermined form in a main board during manufacturing. According to another embodiment, the information about the test patches is input into a program of a computer, either manually or uploaded from a recordable medium or over a network.

However the information is received, when the quality of a printed image is determined as having deteriorated during operation of the printer, a user may suspect contamination of the developing solutions and command the printer to print the test patches. In response to the user's command, the printer prints the test patches as shown in FIG. 6.

In comparing the test patches of FIG. 6 with the sample patches of FIG. 4, the color of the test patch of yellow is darker and more turbid than the color of a sample patch of yellow corresponding to a standard color difference of 8. From the standard color difference of 8, it is concluded that the yellow developing solution is very polluted. Specifically, assuming a time to replace a developing solution is when the color of a test patch is more polluted than the color of a sample patch corresponding to a standard color difference $\Delta E^*$ of 6, a user examines the test patches of FIG. 6 with the naked eye, and replaces only the yellow developing solution with a new one. The user can determine with the naked eye that the test patches of the other colors have measured color differences $\Delta E$ and standard color differences $\Delta E^*$ of less than 6.

The embodiment of the present invention allows a user to visually compare the colors of test patches with the standard colors $E_s^*$ and the measured standard polluted colors $E_c^*$ which are provided in the reference card to determine whether to replace a developing solution without a separate measuring apparatus. As such, a time to replace a developing solution can be determined at low cost.

According to an embodiment of the invention, a measuring apparatus having a simple sensor is provided within a printer to provide measured contamination values $E_c$ of the test patches in addition to printing of the test patches. If the separate measuring apparatus is provided in a printer, users can easily determine the degrees of contamination of developing solutions from the measured contamination values $E_c$, but the manufacturing cost of printers may increase.

Figure 7:
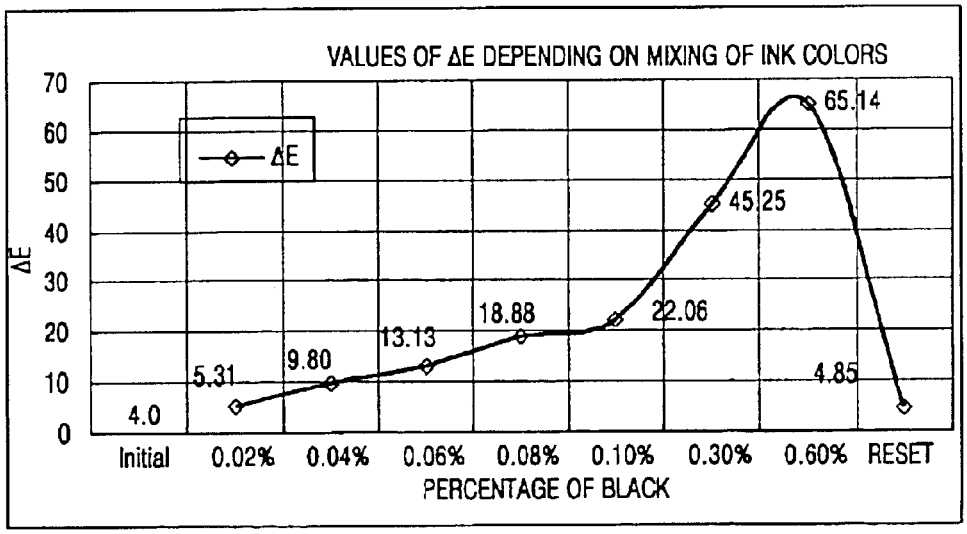
FIG. 7 is a graph of color differences with respect to a mixed color of yellow and black in a method of determining a time to replace a developing solution according to an embodiment of the present invention.

FIG. 7 is a graph of measured color differences $\Delta E$ versus the amounts of a black toner mixed into a yellow toner based on the following table.

| | | L | a | b | ΔE |
|---|---|---|---|---|---|
| Initial | Yellow | 90.13 | −1.688 | 95.824 | |
| 0.02% | Yellow | 86.982 | −1.874 | 91.558 | 5.305022 |
| 0.04% | Yellow | 83.714 | −1.736 | 88.418 | 9.798785 |
| 0.06% | Yellow | 80.432 | −1.65 | 86.97 | 13.13187 |
| 0.08% | Yellow | 79.316 | −2.724 | 80.384 | 18.87881 |
| 0.10% | Yellow | 75.868 | −2.106 | 78.998 | 22.06113 |
| 0.30% | Yellow | 63.234 | −1.478 | 61.292 | 45.25286 |
| 0.60% | Yellow | 54.22 | −1.212 | 43.334 | 65.13856 |
| Reset | Yellow | 87.806 | −2.672 | 91.688 | 4.845175 |

Referring to the above table and the graph of FIG. 7, as a contamination of the yellow toner increases due to mixing of the black toner, the values of L and "b" remarkably drop, and the values of "a" remain roughly similar. The measured color differences $\Delta E$ linearly increase in proportion to the amount of the mixed black toner. When a reference for a time to replace a developing solution is set as a color difference of 6 according to an embodiment of the present invention, it can be inferred that it is necessary to replace a yellow developing solution whit a new one when the black toner of more than 0.02% is mixed into the yellow toner.

According to another embodiment of the invention, the test patches are printed together with measured contamination values $E_c$ of the respective test patches. According to an embodiment of the invention, each of the measured contamination values $E_c$ is defined by three variable values including a measured contamination value of lightness $L_c$, a measured contamination value of red-greenness $a_c$, and a measured contamination value of yellow-blueness $b_c$. Measured color differences $\Delta E$ corresponding to the measured contamination values $E_c$ of the respective test patches are printed together with the test patches. The measured color differences $\Delta E$ satisfy the following conditions:

$$\Delta E=\{(\Delta L)^2+(\Delta a)^2+(\Delta b)^2\}^{1/2}$$

$$\Delta L=L_s^*-L_c$$

$$\Delta a=a_s^*-a_c$$

$$\Delta b=b_s^*-b_c$$

where $L_s^*$ is a standard value of lightness, $a_s^*$ is a standard value of red-greenness, and $b_s^*$ is a standard value of yellow-blueness.

In comparing the sample patches with the test patches according to an embodiment of the invention, the measured standard contamination values $E_c^*$ of the sample patches with the measured contamination value $E_c$ of the test patches are compared. One of the developing solutions is replaced when the measured contamination value $E_c$ of the test patch corresponding to the color of the one developing solution is greater than the measured standard contamination value $E_c^*$ of the one sample patch corresponding thereto.

According to another embodiment, the standard color differences $\Delta E^*$ of the sample patches are compared with the measured color differences $\Delta E$ of the test patches. One of the developing solutions is replaced when the measured color difference $\Delta E$ of a test patch corresponding to the color of the one developing solution is greater than the standard color difference $\Delta E^*$ of a sample patch corresponding thereto.

According to a method of determining a time to replace a developing solution according to the embodiment of the present, a reference card in which sample patches corresponding to standard color values and color differences are arranged is provided together with a printer, so an expensive measuring apparatus is not required to determine the degree of contamination of a developing solution. Accordingly, the present invention can provide a way to determine when to replace a developing solution that is simply determined at low cost. It is also understood that Equation (1) can be adjusted for color coordinate systems using more than three coordinate values.

While this invention has been particularly shown and described with reference to embodiments thereof, the embodiments are used in a descriptive sense only. Particularly, it will be apparent to those skilled in the art that a color space may be defined by other variables, test patches may be provided in other forms, and color differences with respect to test patches may be provided together with the test patches. Therefore, the scope of the invention will be defined not by the above-described embodiment but by the technological spirit of the accompanying claims and equivalents thereof.

As described above, a method of determining a time to replace a developing solution of a wet printer according to the present invention provides a reference card including sample patches according to standard colors and color differences and test patches installed in a printer so that a user can easily determine whether to replace a developing solution at low cost.

What is claimed is:

1. A method of determining a time to replace a developing solution in a wet electrophotographic printer including developing solutions of predetermined colors, the method comprising:

providing a reference card including sample patches of standard colors for the predetermined colors of the developing solutions, sample patches of test colors into which the standard colors have been changed due to contamination with other colors, and standard color differences $\Delta E^*$ calculated from standard color values $E_s^*$ corresponding to the respective standard colors and measured standard contamination values $E_c^*$ corresponding to the respective test colors;

inputting information about test patches for the predetermined colors into the printer and printing the test patches; and comparing the sample patches with the test patches to determine whether to replace one of the developing solutions.

2. The method of claim 1, wherein said providing the reference card comprises:

setting the standard colors for the predetermined colors and the test colors into which each of the standard colors change depending on an amount of the contamination;

calculating the standard color values $E_s^*$ corresponding to the respective standard colors and the measured standard contamination values $E_c^*$ corresponding to the respective test colors;

calculating the standard color differences $\Delta E^*$ from the standard color values $E_s^*$ and the measured standard contamination values $E_c^*$; and providing the reference card in which the sample patches corresponding to the standard colors and the sample patches corresponding to the test colors are arranged in order of increasing amounts of the standard color differences $\Delta E^*$.

3. The method of claim 2, wherein each of the standard color values $E_s^*$ is defined by a standard value of lightness $L_s^*$, a standard value of red-greenness $a_s^*$, and a standard value of yellow-blueness $b_s^*$.

4. The method of claim 3, wherein each of the measured standard contamination values $E_c^*$ is defined by a measured standard contamination value of lightness $L_c^*$, a measured standard contamination value of red-greenness $a_c^*$, and a measured standard contamination value of yellow-blueness $b_c^*$.

5. The method of claim 4, wherein the standard color differences $\Delta E^*$ satisfy the following conditions:

$$\Delta E^*=\{(\Delta L^*)^2+(\Delta a^*)^2+(\Delta b^*)^2\}^{1/2},$$

$$\Delta L^*=L_s^*-L_c^*,$$

$$\Delta a^*=a_s^*-a_c^*, \text{ and}$$

$$\Delta b^*=b_s^*-b_c^*.$$

6. The method of claim 5, wherein said inputting the information about the test patches and printing the test patches comprises:

inputting the information about the test patches into the printer;

commanding the printer to print the test patches in accordance with the information; and printing the test patches in response to the command.

7. The method of claim 6, wherein the printed test patches comprise measured contamination values $E_c$ of the respective test patches.

8. The method of claim 7, wherein each of the measured contamination values $E_c$ is defined by a measured contamination value of lightness $L_c$, a measured contamination value of red-greenness $a_c$, and a measured contamination value of yellow-blueness $b_c$.

9. The method of claim 7, wherein the printed test patches comprise measured color differences $\Delta E$ corresponding to the measured contamination values $E_c$ of the respective test patches.

10. The method of claim 9, wherein the measured color differences $\Delta E$ satisfy the following conditions:

$$\Delta E=\{(\Delta L)^2+(\Delta a)^2+(\Delta b)^2\}^{1/2},$$

$$\Delta L=L_s^*-L_c,$$

$$\Delta a=a_s^*-a_c,$$

$$\Delta b=b_s^*-b_c,$$

where $L_c$ is a measured contamination value of lightness, $a_c$ is a measured contamination value of red-greenness, and $b_c$ is a measured contamination value of yellow-blueness.

11. The method of claim 9, wherein said comparing the sample patches with the test patches comprises:

comparing the standard color differences $\Delta E^*$ of the sample patches with the measured color differences $\Delta E$ of the test patches; and replacing the one developing solution upon a determination that the measured color difference $\Delta E$ of one of the test patches corresponding to the color of the one developing solution is greater than the standard color difference $\Delta E^*$ of a predetermined one of the sample patches corresponding to the one test patch.

12. The method of claim 9, wherein said comparing the sample patches with the test patches comprises:

comparing the measured standard contamination values $E_c^*$ of the sample patches with the measured contamination value $E_c$ of the test patches; and replacing the one developing solution upon a determination that the measured contamination value $E_c$ of one of the test patches corresponding to the color of the one developing solution is greater than the measured standard contamination value $E_c^*$ of a predetermined one of the sample patches corresponding to the one test patch.

13. The method of claim 9, wherein said comparing the sample patches with the test patches comprises:

comparing the standard color differences $\Delta E^*$ of the sample patches with the measured color differences $\Delta E$ of the test patches; and replacing the one developing solution upon a determination that the measured color difference $\Delta E$ of one of the test patches corresponding to the color of the one developing solution is greater than the standard difference $\Delta E^*$ of a predetermined one of the sample patches corresponding to the one test patch.

14. The method of claim 7, wherein said comparing the sample patches with the test patches comprises:

comparing the measured standard contamination values $E_c^*$ of the sample patches with the measured contamination value $E_c$ of the test patches; and replacing the one developing solution upon a determination that the measured contamination value $E_c$ of one of the test patches corresponding to the color of the one developing solution is greater than the measured standard contamination value $E_c^*$ of a predetermined one of the sample patches corresponding to the one test patch.

15. The method of claim 2, wherein each of the measured standard contamination values $E_c^*$ is defined by a measured standard contamination value of lightness $L_c^*$, a measured standard contamination value of red-greenness $a_c^*$, and a measured standard contamination value of yellow-blueness $b_c^*$.

16. The method of claim 15, wherein the standard color differences $\Delta E^*$ satisfy the following conditions:

$$\Delta E^*=\{(\Delta L^*)^2+(\Delta a^*)^2+(\Delta b^*)^2\}^{1/2},$$

$$\Delta L^*=L_s^*-L_c^*,$$

$$\Delta a^*=a_s^*-a_c^*,$$

$$\Delta b^*=b_s^*-b_c^*,$$

in which $L_s^*$ is a standard value of lightness, $a_s^*$ is a standard value of red-greenness, and $b_s^*$ is a standard value of yellow-blueness.

17. The method of claim 16, wherein said inputting the information about the test patches and printing the test patches comprises:

inputting the information about the test patches into the printer;

commanding the printer to print the test patches in accordance with the information; and printing the test patches in response to the command.

18. The method of claim 17, wherein the printed test patches comprise measured contamination values $E_c$ of the respective test patches.

19. The method of claim 18, wherein each of the measured contamination values $E_c$ is defined by a measured contamination value of lightness $L_c$, a measured contamination value of red-greenness $a_c$, and a measured contamination value of yellow-blueness $b_c$.

20. The method of claim 18, wherein the printed test patches comprise measured color differences $\Delta E$ corresponding to the measured contamination values $E_c$ of the respective test patches.

21. The method of claim 20, wherein the measured color differences $\Delta E$ satisfy the following conditions:

$$\Delta E=\{(\Delta L)^2+(\Delta a)^2+(\Delta b)^2\}^{1/2},$$

$$\Delta L=L_s^*-L_c,$$

$$\Delta a=a_s^*-a_c,$$

$$\Delta b=b_s^*-b_c,$$

where $L_c$ is a measured contamination value of lightness, $a_c$ is a measured contamination value of red-greenness, and $b_c$ is a measured contamination value of yellow-blueness.

22. The method of claim 20, wherein said comparing the sample patches with the test patches comprises:

comparing the standard color differences $\Delta E^*$ of the sample patches with the measured color differences $\Delta E$ of the test patches; and replacing the one developing solution upon a determination that the measured color difference $\Delta E$ of one of the test patches corresponding to the color of the one developing solution is greater than the standard color difference $\Delta E^*$ of a predetermined one of the sample patches corresponding to the one test patch.

23. The method of claim 22, further comprising providing information as to which one of the sample patches comprises the predetermined one sample patch.

24. The method of claim 18, wherein said comparing the sample patches with the test patches comprises:

comparing the measured standard contamination values $E_c^*$ of the sample patches with the measured contamination value $E_c$ of the test patches; and replacing the one developing solution upon a determination that the measured contamination value $E_c$ of one of the test patches corresponding to the color of the one developing solution is greater than the measured standard contamination value $E_c^*$ of one of the sample patches corresponding to the one test patch.

25. The method of claim 17, wherein the information about the test patches is programmed into a main board of the printer.

26. The method of claim 17, wherein the information about the test patches is uploaded into the printer.

27. The method of claim 17, wherein the information about the test patches is provided to a user of the printer, and the user enters the information into the printer.

28. A method of providing a reference card for use in determining a time to replace a developing solution in a wet electrophotographic printer including developing solutions of predetermined colors, the method comprising:

obtaining standard color values $E_s^*$ corresponding to standard colors for the predetermined colors;

obtaining measured standard contamination values $E_c^*$ corresponding to respective test colors, each of the test colors being a color resulting when one of the standard colors changes due to mixing with another of the standard colors;

calculating standard color differences $\Delta E^*$ from the standard color values $E_s^*$ and the measured standard contamination values $E_c^*$ ; and printing sample patches onto the reference card in order of increasing or decreasing amounts of the standard color differences $\Delta E^*$, each of the sample patches corresponding to one of the test colors.

29. The method of claim 28, wherein each of the standard color values $E_s^*$ is defined by three variable values including a standard value of lightness $L_s^*$, a standard value of red-greenness $a_s^*$, and a standard value of yellow-blueness $b_s^*$.

30. The method of claim 29, wherein each of the measured standard contamination values $E_c^*$ is defined by three variable values including a measured standard contamination value of lightness $L_c^*$, a measured standard contamination value of red-greenness $a_c^*$, and a measured standard contamination value of yellow-blueness $b_c^*$.

31. The method of claim 30, wherein in said calculating the standard color differences $\Delta E^*$, the standard color differences $\Delta E^*$ satisfy the following conditions:

$$\Delta E^*=\{(\Delta L^*)^2+(\Delta a^*)^2+(\Delta b^*)^2\}^{1/2},$$

$$\Delta L^*=L_s^*-L_c^*,$$

$$\Delta a^*=a_s^*-a_c^*, \text{ and}$$

$$\Delta b^*=b_s^*-b_c^*.$$

32. The method of claim 31, further comprising determining a relationship between the obtained measured standard contamination values $E_c^*$ for each test color and corresponding amounts of the another of the standard colors mixed with each test color; and determining a gradation between adjacent pairs of sample patches of the standard color differences $\Delta E^*$ to be printed on the reference card, wherein:

the calculated standard color differences $\Delta E^*$ are calculated using the relationship and the determined gradation, and adjacent pairs of the printed sample patches have a difference in the corresponding standard color differences $\Delta E^*$ equal to the gradation.

33. The method of claim 32, wherein the gradation is 2, and the standard color differences $\Delta E^*$ are printed on the reference card adjacent the corresponding sample patches.

34. The method of claim 32, wherein the adjacent sample patches are separated so as to be distinct from each other.

35. A reference card for use in determining a time to replace a developing solution in a wet electrophotographic printer including developing solutions of predetermined colors, comprising:

sample patches printed onto the reference card, each of the sample patches corresponding to one of a plurality of test colors arranged in order of increasing or decreasing amounts of standard color differences $\Delta E^*$, wherein:

each of the standard color differences $\Delta E^*$ being determined according to a relationship between standard color values $E_c^*$ and measured standard contamination values $E_c^*$, the standard color values $E_s^*$ corresponds to standard colors for the predetermined colors used in the printer, and the measured standard contamination values $E_c^*$ correspond to the respective test colors, each of the test colors being a color resulting when one of the standard colors changes due to mixing with another of the standard colors.

36. The reference card of claim 35, wherein adjacent sample patches are separated.

37. The reference card of claim 35, wherein:

each of the standard color values $E_s^*$ is defined by three variable values including a standard value of lightness $L_c^*$, a standard value of red-greenness $a_s^*$, and a standard value of yellow-blueness $b_s^*$, each of the measured standard contamination values $E_c^*$ is defined by three variable values including a measured standard contamination value of lightness $L_c^*$, a measured standard contamination value of red-greenness $a_c^*$, and a measured standard contamination value of yellow-blueness $b_c^*$, and the standard color differences $\Delta E^*$ satisfy the following conditions:

$$\Delta E^* = \{(\Delta L^*)^2 + (\Delta a^*)^2 + (\Delta b^*)^2\}^{1/2},$$

$$\Delta L^* = L_s^* - L_c^*,$$

$$\Delta a^* = a_s^* - a_c^*, \text{ and}$$

$$\Delta b^* = b_s^* - b_c^*.$$

38. The reference card of claim 37, wherein a relationship is determined between the measured standard contamination values $E_c^*$ for each test color and corresponding amounts of the another of the standard colors mixed with each test color, a gradation of the standard color differences $\Delta E^*$ of adjacent ones of the sample patches on the reference card is determined, measured standard contamination values $E_c^*$ and standard color differences $\Delta E^*$ are calculated using the relationship and the determined gradation, and adjacent pairs of the sample patches have a difference in the corresponding standard color differences $\Delta E^*$ equal to the gradation.

39. The reference card of claim 38, wherein the gradation is 2, and the standard color differences $\Delta E^*$ are printed on the reference card adjacent the corresponding sample patches.

* * * * *